US006884978B2

(12) United States Patent
Monforton et al.

(10) Patent No.: US 6,884,978 B2
(45) Date of Patent: Apr. 26, 2005

(54) EASILY EXPANDABLE, FLEXIBLE PAPER POPCORN PACKAGE

(75) Inventors: Randal J Monforton, Minnetrista, MN (US); Dawn Falasz, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 10/676,826

(22) Filed: Sep. 30, 2003

(65) Prior Publication Data

US 2005/0067411 A1 Mar. 31, 2005

(51) Int. Cl.[7] ..... H05B 6/80

(52) U.S. Cl. ..... 219/727; 219/735; 219/740; 219/730; 426/107; 426/113; 206/219

(58) Field of Search ..... 219/727, 735, 219/740, 730; 426/107, 113, 120, 124; 206/219

(56) References Cited

U.S. PATENT DOCUMENTS 4,450,180 A 5/1984 Watkins
4,596,713 A * 6/1986 Burdette ..... 426/107
4,691,374 A 9/1987 Watkins et al.
4,735,513 A 4/1988 Watkins et al.
4,878,765 A 11/1989 Watkins et al.
5,044,777 A 9/1991 Watkins et al.
5,488,220 A 1/1996 Freerks et al.

* cited by examiner

*Primary Examiner*—Shawntina Fuqua
(74) *Attorney, Agent, or Firm*—John A. O'Toole; Alan D. Kamrath; Douglas J. Taylor

(57) ABSTRACT

A flexible paper popcorn package in the form of an easily expandable bag (18) includes a bottom wall (20), a top wall (22), first and second, pleated, side walls (26) having pleats (26*a*–26*d*), and first and second non-venting ends (24, 28). Spots (60, 62) of adhesive may be provided between the pleats (26*a*–*d*) and the top and bottom walls (20, 22) to prevent the formation of pockets adjacent the end (24). Couplers (70) formed of adhesive are provided between the pleats (26*b*, 26*d*) and the top wall (22) which seal apertures (72) in the pleats (26*b*, 26*d*) which vent during microwave popping, puffing, or expanding of a food product held in the bag (18) and which may predispose unfolding of the pleats (26*a*, 26*c*) adjacent the bottom wall (20) including the susceptor (30).

20 Claims, 3 Drawing Sheets

EASILY EXPANDABLE, FLEXIBLE PAPER POPCORN PACKAGE

BACKGROUND

The present invention relates generally to packages for use in microwave ovens, pertains more particularly to an easily expandable, flexible popcorn package, and pertains specifically to an easily expandable, flexible popcorn package minimizing rapid leaking of fluid contents.

U.S. Pat. No. 5,488,220 describes a conventional microwave cooking bag which has achieved considerable market success. Such bags are designed to intentionally vent along its top end which is intended to be opened after the popcorn has been popped and when held in a vertical orientation. When removed from the microwave oven, the bag is often orientated such that the bottom end is closest the microwave door opening and thus is often grasped by the user for purposes of removing the bag from the microwave oven. When so grasped, the bag will tend to be held in an inverted orientation, i.e., with the bottom end being in a vertically upward position while the top end is in a vertically lower position. In such a position, any liquid or fluid material such as melted fat can leak or freely flow through the vent opening in the top end. Such liquid or fluid material flowing from the vent opening may come in contact with persons removing the bag from the microwave oven or persons or pets nearby. This has not poised a significant problem for most buttered or unbuttered popped popcorn as the amount of liquid or fluid material is small. This could be a problem if the popcorn was severely underpopped, the fat, oil, butter or the like was in a flowable condition, and the bag had vented, the frequency of which together with the unlikely event that contact, especially contact of any significant length of time, is not significant. However, the proposed introduction of isomalt sweet coated popcorn or similar products for preparing a carmel microwave popcorn (see, USSS entitled "SWEET MICROWAVE POPCORN AND METHOD OF PREPARATION" to H. Teoh) has significantly increased the possibility of contact with persons or pets with a hot liquid or fluid material. Specifically, ingredients for such sweetened popcorn packages are intended to result in larger amounts of a hot viscous slurry during the popping of the popcorn which is intended to coat the popcorn during popping. The time for such slurry to cool down to transform from a flowable state to a non-flowable state can be longer than hurried consumers expect (based upon prior experience with fat flavored microwave popcorn), and the amount of such slurry is significantly greater than the amount of liquid or fluid material in a buttered or unbuttered popcorn package. Another factor is that such molten carbohydrate slurry is intended to coat the popped popcorn and thus has a greater tendency to cling to skin or other surface rather than run therefrom such as in the case of oil, fat, butter, or the like.

Thus, a need exists for a microwave popcorn popping bag and methods for minimizing contact of liquid or fluid material exiting a bag as the bag is being removed from a microwave oven or being transported thereafter.

SUMMARY

The above need and other problems in the field of heating a food product in a microwave oven is satisfied by providing, in the most preferred form, a bag having first and second walls which at least partially defines an interior holding a charge of food product. In a collapsed condition, a coupler bonds the first and second walls together when the first wall overlays the second wall. An aperture is located within the outer periphery of the coupler. The coupler prevents communication with the interior through the aperture until released during heating of the food product at which time venting of the interior through the aperture occurs.

Thus, it is an objective of the present invention to provide a novel expandable microwave package.

It is further an objective of the present invention to provide such a novel expandable microwave package minimizing contact of exiting liquid or fluid material.

It is further an objective of the present invention to provide such a novel expandable microwave package preferably providing preferential venting locations.

It is further an objective of the present invention to provide such a novel expandable microwave package preferably having non-venting ends.

It is further an objective of the present invention to provide such a novel expandable microwave package preferably which can be manufactured and filled utilizing conventional equipment.

It is further an objective of the present invention to provide such a novel expandable microwave package preferably which can be opened for access utilizing the currently taught and recognized technique of cross corner pulling to open an end seal.

It is further an objective of the present invention to provide such a novel expandable microwave package preferably having a conventional appearance.

These and further objectives of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
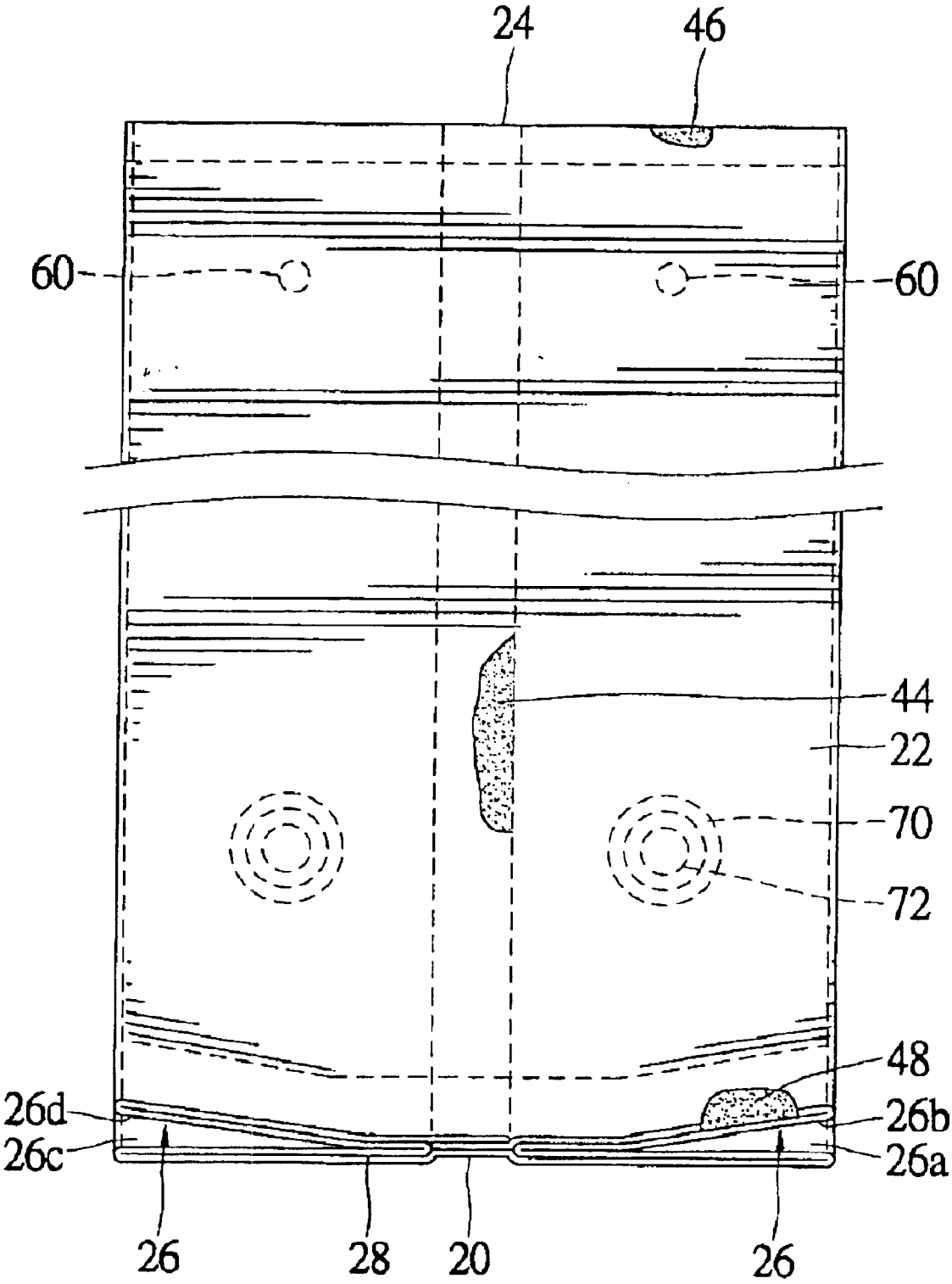
FIG. 1 shows a perspective view of a package fabricated in accordance with the preferred teachings of the present invention in generally a collapsed, flat condition, but illustrated slightly expanded to show constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

An easily expandable microwave package for holding a food product for popping, puffing or expanding in a microwave oven according to the preferred teachings of the present invention is shown as an expandable, flexible bag in the drawings and generally designated 18. It will facilitate the ensuing description to consider bag 18 in the horizontal position when placed in the microwave oven as opposed to a vertical or upright position when the contents of bag 18 are being consumed by the consumer. Therefore, bag 18 includes a bottom wall 20, a top wall 22, a first end 24, side walls 26 and a second end 28. In the preferred form, the width of bottom wall 20 is equal to the width of top wall 22, although the widths of walls 20 and 22 could be different. Walls 20, 22 and 26 define an interior for holding a charge of food product to be subjected to microwave energy.

In the most preferred form, side walls 26 include gussets or pleats 26*a*, 26*b*, 26*c* and 26*d* that enable side walls 26 to expand during a heating cycle. Particularly, in the preferred form, pleats 26*a* and 26*b* are connected together at first, inner edges and have second and third, opposite, outer edges connected to bottom wall 20 and top wall 22, respectively. Likewise, pleats 26*c* and 26*d* are connected together at fourth, inner edges and have fifth and sixth, opposite, outer edges connected to bottom wall 20 and top wall 22, respectively. In the preferred form, in its collapsed condition, pleats 26*a* and 26*c* have the same width and overlie bottom wall 20, and pleats 26*b* and 26*d* have the same width which is equal to the width of pleats 26*a* and 26*c* and overlie pleats 26*a* and 26*c*, with top wall 22 overlying pleats 26*b* and 26*d*. In the preferred form, bottom and top walls 20 and 22 have a width extending beyond the inner, interconnected edges of pleats 26*a* and 26*b* and of pleats 26*c* and 26*d* when bag 18 is in its collapsed or folded condition. The first and second, free ends of pleats 26*a*, 26*b*, 26*c* and 26*d*, the first and second, free ends of bottom wall 20, and the first and second, free ends or top wall 22 are co-planar, and have the same extent or length.

Attention is now directed to a susceptor patch 30 that extends over a portion of bottom wall 20 spaced from ends 24 and 28. Susceptor patch 30 can be formed in any suitable manner known in the art such as a metalized plastic film adhered to bottom wall 20, as a paper backed susceptor, or as a coating, applied or printed to bottom wall 20. Further, although susceptor patch 30 is shown as overlying bottom wall 20 and thus located inside of bag 18, susceptor patch 30 can be located outside of bag 18 with bottom wall 20 overlying susceptor patch 30. Further, placement of susceptor patch 30 can occur at the material convertor or on the manufacturing lines. It can then be appreciated that bag 18 can be manufactured as current bags are manufactured for example of the type shown and described in U.S. Pat. No. 4,450,180; 4,691,374; 4,735,513; 4,878,765; or 5,044,777. In this regard, bag 18 can be formed by cutting a web of material to length to form a sheet 42 and folding that sheet 42 to form the tubular bag stock including bottom, top, and side walls 20, 22, and 26. It should also be noted that the ends of bottom, top, and side walls 20, 22, and 26 are all of the same length and specifically do not require any special cuts and/or do not require extra components to form tabs or flaps. In the most preferred form of the present invention, a suitable adhesive strip 44 is added during formation at the overlapping edges of sheet 42 to form a longitudinally extending lap seal to create the tubular bag stock. The lap seal is of a constant width and extends the full length between the first and second ends of top wall 22.

According to the preferred teachings of the present invention, first and second adhesive strips 46 and 48 are preapplied on the inside surface of sheet 42 prior to its formation as a tubular bag stock and extend inwardly from the ends of sheet 42. Strips 46 and 48 and their inside edges are parallel to the ends of sheet 42 and each other. Strips 46 and 48 can be of the same or different widths substantially less than the length between the first and second ends of bottom, top and side walls 20, 22, and 26, with the widths of strips 46 and 48 being constant in the most preferred form. Strips 46 and 48 extend the full width of sheet 42 between the edges thereof which are overlapped to create the tubular bag stock.

In the preferred form, the inside surface of sheet 42 includes spots 60 of adhesive on pleats 26*b* and 26*d* and/or top wall 22 adjacent end 24 and spots 62 of adhesive on pleats 26*a* and 26*d* and/or bottom wall 20 adjacent end 24 to prevent the formation of pockets between pleats 26*a-d* and walls 20 and 22. It should be appreciated that one of spots 60 and 62 of adhesive will tend to close any pockets that might otherwise form between walls 20 and 22 and/or pleats 26*a*–26*d* so that the other of spots 60 and 62 may be eliminated, if desired.

All of the structure thus far described in this description of the preferred embodiment is of substantially conventional construction. The most preferred form of the present invention utilizes this conventional construction and is believed to produce synergistic results therewith. However, the teachings of the present invention may have application to other forms of construction than the preferred form shown.

According to the teachings of the present invention, couplers 70 bond pleats 26*b* and 26*d* and top wall 20 together. Specifically, in the most preferred form, coupler 70 is formed on the inside surface of sheet 42 by adhesive on pleats 26*b* and 26*d* and/or top wall 20 adjacent end 28. In particular, each coupler 70 has an outer periphery in the preferred form of a circular shape. In the most preferred form, each coupler 70 is annular in shape and includes an inner periphery smaller than the outer periphery and in the preferred form of a circular shape concentric with the outer periphery. Further, in the preferred form, couplers 70 are continuous within their outer peripheries and between pleats 26*b* and 26*d* and top wall 22.

Further, according to the teachings of the present invention, apertures 72 are formed in pleats 26*b* and 26*d* at positions corresponding to couplers 70 and of a size smaller than couplers 70 and in the most preferred form equidistant from the inner and outer peripheries of couplers 70. Specifically, with apertures 72 of a circular shape as shown and with the inner and outer peripheries of couplers 70 being of a circular shape, apertures 72 are concentrically within couplers 70.

Figure 2:
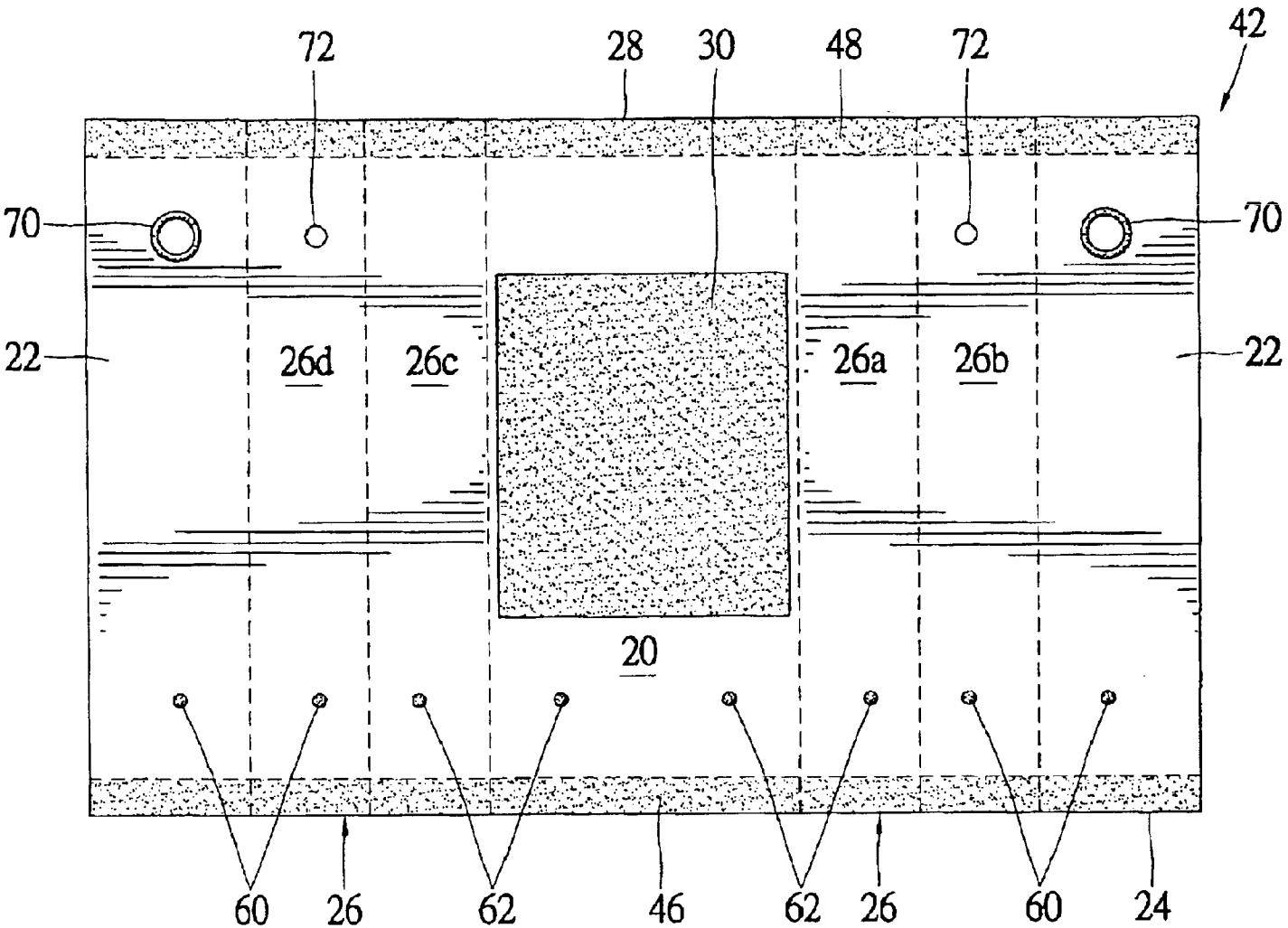
FIG. 2 shows a plan view of the inside surface of the sheet forming the package of FIG. 1.
Figure 3:
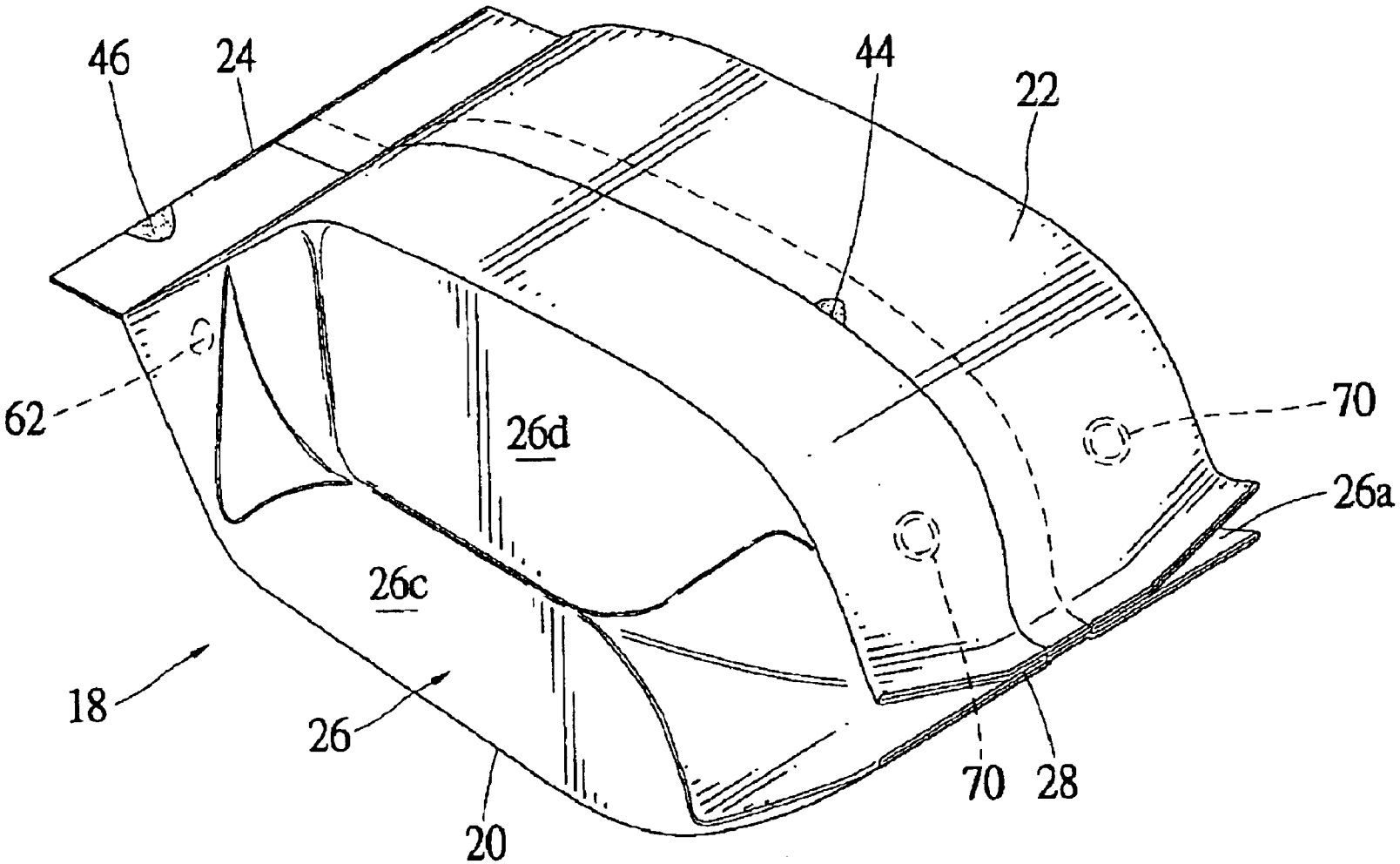
FIG. 3 shows a perspective view of the package of FIG. 1 in an expanded condition.

It should be noted that strips 46 and 48 and couplers 70 in the most preferred form are preferably formed from a thermoplastic adhesive which with the application of heat and pressure will adhere to itself and/or sheet 42. Thus, rather than the patterns as shown in FIG. 2, a large band of adhesive can be applied to sheet 42 and then the heat jaws can be shaped to activate only the portions of the band of adhesive in the desired patterns for strips 46 and 48 and/or couplers 70. In this regard, when cut from a continuous web, strip 46 of a leading sheet 42 and strip 48 of a trailing sheet 42 can be cut from the same band of adhesive, and edges 24 and 28 can be cut from trim extensions provided for manufacturing tolerances. However, it can be appreciated that strips 46 and 48 and couplers 70 can be formed from any suitable material which provides a secure bond therebetween.

End 24 provides an internally stronger seal intended to be a non-opening permanent seal to the first end of bag 18 which forms the lower end of bag 18 when held in its upright position when the contents of bag 18 are being consumed by the consumer. Particularly, in the most preferred form, pressure and heat are applied to the first end of the folded, tubular bag stock to adhere strip 46. It can then be appreciated that strip 46 adheres and seals the inside surface of pleat 26*a* to the inside surface of bottom wall 20, adheres and seals the inside surface of pleat 26*c* to the inside surface of bottom wall 20, adheres and seals the inside surface of pleat 26*b* to the inside surface of top wall 22, and adheres and seals the inside surface of pleat 26*d* to the inside surface of top wall 22. Further, strip 46 adheres and seals bottom wall 20 to top wall 22 intermediate the inner, interconnected edges of pleats 26*a* and 26*b* and of pleats 26*c* and 26*d*, with the strip 46 in the most preferred form being adhered utilizing textured heating jaws. It can be also appreciated that spots 60 and 62 adhere the inside surfaces of pleats 26*b* and 26*d* to the inside surface of top wall 22 and the inside surfaces of pleats 26*a* and 26*c* to bottom wall 20, respectively, which reduce the stress level on strip 46 during bag expansion. Furthermore, couplers 70 bond the inside surface of top wall 22 to the inside surface of pleats 26*b* and 26*d*. In this regard, since apertures 72 are within the inner and outer peripheries of couplers 70, couplers 70 between pleats 26*b* and 26*d* and top wall 22 seal apertures 72 and specifically prevent communication with the interior of bag 18 through apertures 72 before heating of the food product held in bag 18 and in the most preferred form resulting in popping, puffing and expanding of the food product.

End 28 provides an openable, e.g., peelable, closure seal which preferably does not vent during microwave cooking adjacent the second, free ends of bottom, top and side walls 20, 22, and 26 or in other words, adjacent the second end of bag 18 which forms the upper end of bag 18 when held in its upright position when the contents of bag 18 are being consumed by the consumer. Particularly, it can be appreciated that bag 18 can be filled with the desired food product as current bags arc filled for example of the type shown and described in U.S. Pat. No. 4,450,180. After filling, strip 48 can be adhered to walls 20, 22, and 26 utilizing standard equipment presently utilized to form the peelable seal of current bags. Specifically, in the most preferred form, pressure and heat are applied to the second end of the filled bag 18 to adhere strip 48. It can then be appreciated that strip 48 adheres and seals the inside surface of pleat 26*a* to the inside surface of bottom wall 20, adheres and seals the inside surface of pleat 26*c* to the inside surface of bottom wall 20, adheres and seals the inside surface of pleat 26*b* to the inside surface of top wall 22, and adheres and seals the inside surface of pleat 26*d* to the inside surface of top wall 22. Further, strip 48 adheres and seals bottom wall 20 to top wall 22 intermediate the inner, interconnected edges of pleats 26*a* and 26*b* and of pleats 26*c* and 26*d*. It of course should be appreciated that the particular manner of manufacture and filling of bag 18 can be done in a variety of ways and manners such as but not limited to the example set forth above.

For the sake of completeness, it will be assumed that the contents of bag 18 are popcorn kernels having been popped when in the microwave oven. Particularly, as with current bags, bag 18 in a collapsed condition is placed in a microwave oven with bottom wall 20 resting upon the bottom surface of the oven cavity. When subjected to microwave energy, susceptor patch 30 converts microwave energy into heat, with the heat and remaining microwave energy causing the popping of the kernels and the creation of water vapor. The water vapor and heated air cause side walls 26 to expand to extend from their connecting edges at an angular relation to each other and the inside surfaces of pleats 26*a*, 26*b*, 26*c*, and 26*d* being spaced from the inside surfaces of bottom and top walls 20 and 22, expanding bag 18 and increasing the interior volume inside of bag 18 for the popped kernels. It can then be appreciated that due to its flexible nature, bag 18 of the preferred form shown will expand to an ovoid or football like shape, including separating pleats 26*a* and 26*b* and pleats 26*c* and 26*d* adjacent to the first and second ends of bottom, top and side walls 20, 22, and 26.

During the popping, puffing or expanding process, at least one of couplers 70 at least partially releases bonding between the inside surface of top wall 22 and pleat 26*b* and/or 26*d* allowing communication with the interior of bag 18 through aperture(s) 72 sufficiently to allow venting of the interior of bag 18 through aperture(s) 72. The desired timing of when venting occurs is well known in microwave popcorn popping fields and can be controlled by a variety of factors including but not limited to spacing of couplers 70 from strip 48 and/or the outer edges of pleats 26*b* and 26*d*, the type of adhesive forming couplers 70, the shape of couplers 70, the minimum distance and orientation of the outer periphery of couplers 70 to apertures 72, the presence or absence of additional spots or other mechanisms to prevent the separation of pleats 26*b* and 26*d* from top wall 22 and/or the formation of pockets therebetween, and the like. Likewise in the preferred form, venting occurs through only one of apertures 72 because the factors which tend to release couplers 70 will be significantly reduced on the second aperture 72 after the first aperture 72 has vented.

Bag 18 according to the preferred teachings of the present invention can overcome the deficiencies of conventional bags. Particularly, ends 24 and 28 according to the teachings of the present invention generally do not vent while the popcorn kernels are popping in the microwave oven. If pulled from the microwave oven or transported in a vertical orientation by holding top end 28, any liquid or fluid material will tend to flow toward bottom end 24 inside of the interior of bag 18 where it is contained and will not drain from bag 18. If pulled from the microwave oven or transported in a vertical orientation by holding bottom end 24, any liquid or fluid material will tend to flow toward end 28 but will not flow from end 28 as in prior bags as end 28 tends not to vent according to the preferred teachings of the present invention. According to the teachings of the present invention, apertures 72 should be spaced a sufficient distance from end 28 such that a sufficient volume exists in bag 18 to contain any liquid or fluid material before it exits apertures 72 when bag 18 is held in a vertical orientation (in the event that bonding provided by couplers 70 has been released). During popping and in the preferred orientation with wall 20 being in the lowermost horizontal position within the microwave oven, apertures 72 are in an uppermost vertical position such that exit of any liquid or flowable material therethrough (in the event that bonding provided by couplers 70 has been released) does not occur because of gravitational factors. In the event that bag 18 is attempted to be popped in an inverted position with top wall 22 being in the lowermost horizontal position within the microwave oven, the top wall 22 should have an arcuate shape due to the ovoid or football like shape, and apertures 72 should be positioned sufficiently close to end 28 to capture any liquid or flowable material in top wall 22 and/or to delay flow of liquid or fluid material sufficiently to reasonably avoid concern (in the event that bonding provided by couplers 70 has been released).

Couplers 70 according to the teachings of the present invention are utilized for closing apertures 72, and specifically their primary function is not to interconnect walls 20 and 26 forming bag 18 together to define the interior. With bag 18 of the preferred form shown, pleats 26*b* and 26*d* are interconnected to top wall 22 by a fold line, and not being separately formed, and by adhesive strip 48, and, in particular, couplers 70 are not required to form bag 18 having an interior. Additionally, couplers 70 according to the preferred teachings of the present invention prevent the formation of pockets adjacent to top end 28 and also predispose unfolding pleats 26*a* and 26*c* from bottom wall 20 adjacent to end 28 when walls 20 and 22 are pulled apart for filling to insure that the contents of bag 18 is positioned on susceptor patch 30. However, it can be appreciated that spots of adhesive similar to spots 60 and 62 can be provided between pleats 26*b* and 26*d* for providing this predisposed function if the form and/or placement of couplers 70 does not perform this function in the desired manner. In this regard, the proficiency of such combined function couplers 70 of the preferred form shown may not be equal to that produced by separate spots and couplers 70, but such proficiency may not be necessary especially when spots 60 and/or 62 are provided and/or may not be desired, due to other design considerations or choices.

Although apertures 72 are shown as being circular openings in the preferred form, apertures 72 according to the teachings of the present invention can take a variety of forms including openings of various shapes, slits, or the like which can be formed mechanically such as by the use of knives, electrically such as by the use of lasers or arcs, or in other manners. Similarly, although apertures 72 are formed in pleats 26*b* and 26*d* so that they are not normally visible especially when bag 18 is collapsed, apertures 72 could be formed alternately or additionally in top wall 22. Likewise, although believed to produce synergistic results especially when utilized with bag 18 of the preferred form shown, couplers 70 and apertures 72 can have other positions and/or locations according to the teachings of the present invention.

Likewise, although a pair of couplers 70 and associated apertures 72 are shown to insure that venting occurs through at least one aperture 72 before through ends 24 and/or 28, one or more than two couplers 70 can be provided and/or more than one aperture 72 can be associated with each coupler 70 according to the teachings of the present invention. In still another variation, one coupler 70 can encircle two, three or even more apertures 72.

When utilized herein, adhesive is intended to cover any mechanism that interconnects walls 20, 22 and 26 together including but not limited to wet or heat seal bonds, which are applied to one or both surfaces, which are interconnected. The selection of bonds providing the desired function within bag 18 according to the teachings of the present invention will be within the skill of persons skilled in the art. In this regard, as end 28 does not vent while the popcorn kernels are popping in the microwave oven, which venting is conventional in prior bags, design considerations should be given to allow ease of separation of strip 48 when it is desired to open bag 18 for access to the popped popcorn and in the preferred form utilizing the currently taught and recognized technique of cross corner pulling to peal open strip 48. Such design considerations include but are not limited to the size and shape of strips 48, the adhesive utilized to form strip 48, the dimensions of walls 20, 22, and 26, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Expandable microwave package for holding a food product for heating in a microwave oven creating internal vapor pressure, comprising, in combination: a bag having an interior for holding a charge of food product to be subjected to microwave energy, with the bag having a first wall and a second wall, with the interior being at least partially defined by the first and second walls, with the bag holding the food product before heating having a collapsed condition with the first wall overlaying the second wall and with the bag having an expanded condition after heating the food product thereby releasing vapor or gas; an aperture formed in one of the first and second walls; and a coupler bonding the first and second walls together, with the coupler having an outer periphery, with the aperture located within the outer periphery, with the coupler and the first and second walls preventing communication with the interior through the aperture before heating of the food product, with the coupler at least partially releasing bonding of the first and second walls allowing communication with the interior through the aperture during heating of the food product.

2. The expandable microwave package of claim 1 with the first and second walls each having an outer edge, with the outer edges of the first and second walls being connected together, with the coupler and the aperture spaced from the outer edges of the first and second walls.

3. The expandable microwave package of claim 2 with the outer edges of the first and second walls being interconnected by a fold line.

4. The expandable microwave package of claim 3 with the second wall including first and second pleats, with the first pleat including the outer edge and an inner edge, and with the second pleat including an inner edge and an outer edge, with the inner edges of the first and second pleats being interconnected by a fold line, with the first pleat overlying the second pleat and being intermediate the first wall and the second pleat, with the coupler and the aperture being intermediate the outer and the inner edges of the first pleat.

5. The expandable microwave package of claim 4 with the aperture being formed in the first pleat and being overlaid by the first wall.

6. The expandable microwave package of claim 5 with the first and second walls each including a first end and a second end, with the first ends of the first and second walls and the second ends of the first and second walls each being sealed together by a seal which does not fail during heating of the food product, with the coupler and the aperture being spaced from the seals of the ends of the walls.

7. The expandable microwave package of claim 6 with the coupler being continuous within the outer periphery.

8. The expandable microwave package of claim 7 with the outer periphery being circular.

9. The expandable microwave package of claim 8 with the aperture being circular and located concentrically within the outer periphery.

10. The expandable microwave package of claim 9 with the coupler including an inner periphery, with the aperture located within and spaced from the inner periphery.

11. The expandable microwave package of claim 4 with the first and second walls each including a first end and a second end, with the first ends of the first and second walls and the second ends of the first and second walls each being sealed together by a seal which does not fail during heating of the food product, with the coupler and the aperture being spaced from the seals of the ends of the walls.

12. The expandable microwave package of claim 1 with the first and second walls each including a first end and a second end, with the first ends of the first and second walls and the second ends of the first and second walls each being sealed together by a seal which does not fail during heating of the food product, with the coupler and the aperture being spaced from the seals of the ends of the walls.

13. The expandable microwave package of claim 1 with the coupler including an inner periphery, with the aperture located within and spaced from the inner periphery.

14. The expandable microwave package of claim 13 with the outer periphery being circular.

15. The expandable microwave package of claim 14 with the aperture being circular and located concentrically within the outer periphery.

16. The expandable microwave package of claim 1 with the outer periphery being circular.

17. The expandable microwave package of claim 16 with the aperture being circular and located concentrically within the outer periphery.

18. The expandable microwave package of claim 1 with the coupler being annular in shape.

19. The expandable microwave package of claim 18 with the aperture located within and spaced from the coupler.

20. The expandable microwave package of claim 1 further comprising a spot of adhesive for preventing formation of pockets between the first and second walls.

* * * * *